United States Patent [19]

Schuplin

[11] 4,027,454

[45] June 7, 1977

[54] HOLD DOWN CLIP FOR CEILING TILE IN GRID-TYPE CEILING

[75] Inventor: Jerome T. Schuplin, Parma Heights, Ohio

[73] Assignee: Fastway Fasteners, Inc., Lorain, Ohio

[22] Filed: Feb. 27, 1976

[21] Appl. No.: 662,101

[52] U.S. Cl. ..... 52/714; 52/489; 403/282; 403/273

[51] Int. Cl.[2] ..... E04B 5/57

[58] Field of Search ..... 52/760, 714, 489

[56] References Cited

UNITED STATES PATENTS

| | | | |
|---|---|---|---|
| 3,565,473 | 2/1971 | Kedel | 52/760 |
| 3,730,466 | 5/1973 | Swanquist | 52/714 X |

FOREIGN PATENTS OR APPLICATIONS

| | | | |
|---|---|---|---|
| 931,731 | 11/1947 | France | 52/760 |
| 573,581 | 11/1945 | United Kingdom | 52/760 |
| 585,311 | 2/1947 | United Kingdom | 52/760 |

*Primary Examiner*—Andrew V. Kundrat
*Attorney, Agent, or Firm*—Baldwin, Egan, Walling & Fetzer

[57] ABSTRACT

A hold down clip for mounting on an inverted T-shaped rib of a grid-type ceiling structure, for holding the ceiling tiles in place. The clip comprises spaced leg portions which are adapted to overlie the tile and at least one foot portion projecting outwardly from the respective leg portion, with such foot portion having tab means thereon for either digging into the underlying tile and anchoring it in place or engaging the adjacent edge surface of the underlying tile in the event the latter is cut short, and maintaining it in position. The clip may be expeditiously formed from flat sheet material, such as sheet metal; in some embodiments the clip comprises more than one pair of leg portions.

13 Claims, 12 Drawing Figures

HOLD DOWN CLIP FOR CEILING TILE IN GRID-TYPE CEILING

This invention relates in general to a hold down clip adapted for mounting in gripping relation on the inverted T-shaped tile support member of a grid-type ceiling, for holding ceiling tile in place relative to the grid structure, and more particularly relates to a hold down clip of the aforedescribed type which embodies tab means thereon which are adapted to either dig into the underlying tile and maintain it in place or engage a confronting edge portion of a "short" tile for aiding in maintaining the tile in position.

BACKGROUND OF THE INVENTION

Hold down clips adapted for maintaining ceiling tile in a grid-type ceiling structure, in place, are known in the prior art. U.S. Pat. No. 3,565,473 issued Feb. 23, 1971 to M. J. Kedel and entiled Hold Down Clip for Tiles in Suspended Ceiling Structure, is an example of one type of hold down clip structure. Such prior art arrangement has a pair of spring feet extending in opposite directions from the plane of each of the legs of the clip, and is comparatively complex to form, resulting in increased costs. Moreover, such clip results in considerable "scrap" or lost material due to its structural arrangement, and in the event that some of the tile are cut "short" the feet on each leg may not engage the underlying tile.

SUMMARY OF THE INVENTION

The present invention provides a hold down clip comprising spaced resilient leg portions for gripping an inverted T-shaped support member of the grid-type ceiling structure, with at least one of the leg portions having a foot portion projecting therefrom adapted to overlie an underlying ceiling tile, and with there being provided tab means on the foot portion for either digging into the tile and maintaining it in proper position on the inverted T-shaped support member, or for engaging an adjacent side edge of the "short" cut tile for aiding in maintaining it in proper position.

Accordingly, an object of the invention is to provide a novel hold down clip for a ceiling tile of a grid-type ceiling and one which will expeditiously maintain the tile in position.

Another object of the invention is to provide a hold down clip of the latter type which includes tab means thereon for facilitating maintenance of the tile in selected position and which is effective whether the tile is cut "long" or "short".

A still further object of the invention is to provide a hold down clip of the aforedescribed type which includes spaced resilient leg sections with feet portions projecting generally laterally from the leg sections and which includes tab means thereon which is adapted to either dig into the tile when the latter is "long" or to engage an adjacent edge of the tile and hold it in predetermined position when the tile is "short".

A still further object of the invention is to provide a hold down clip which can be formed from flat sheet material such as for instance sheet metal and with practically no scrap loss, for assembly with an inverted T-shape, in cross section, ceiling support grid member, and which comprises leg portions for positioning on opposite sides of the vertical rib of the T support, for clasping the rib, and which includes foot portions adapted to overlie underlying ceiling tile supported on the T support and which includes tab means thereon for maintaining the tile in predetermined position with respect to the T support irrespective of whether the tile is "long" or "short".

A still further object of the invention is to provide a hold down clip which is simple in construction and which can be mass produced utilizing mass production procedures, resulting in an economical clip for a grid-type ceiling.

Other objects and advantages of the invention will be apparent from the following description taken in conjunction with the accompanying drawings:

DESCRIPTION OF PREFERRED EMBODIMENTS

Figure 1:
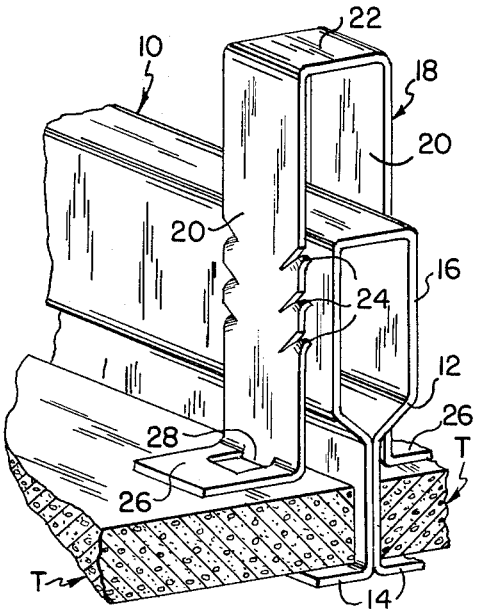
FIG. 1 is a fragmentary perspective view of a hold down clip embodying the invention and mounted on a grid-type ceiling.

Referring now to FIG. 1, there is illustrated a fragmentary portion of a grid-type ceiling which ceiling structure includes inverted, T-shape, in cross section, support members 10 including generally vertical rib 12 and horizontally oriented flanges 14 projecting from opposite sides of the rib 12, and adapted to support thereon ceiling tile T of known type. Support members 10 can be suspended as by wires, rods or any other suitable means from the overhead structure of a building or the like, and in a manner known in the art, to form, for instance, what is called a suspended ceiling structure. In the embodiment illustrated the rib 12 of the support member 10 includes an enlarged end portion 16 of generally rectilinear configuration in cross section, with the member 10 being comprised of any suitable material, such as for instance sheet metal or the like formed into an inverted T-shaped configuration.

Figure 2:
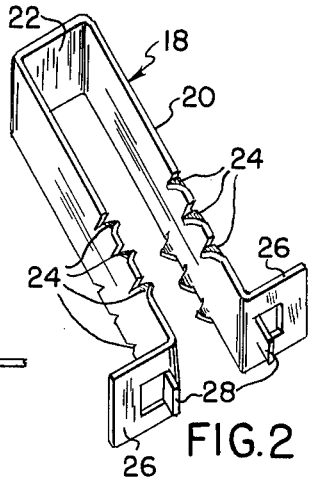
FIG. 2 is a bottom perspective view of the clip illustrated in FIG. 1.

The hold down clips 18 of the invention are provided at spaced intervals coacting with the respective support member 10, for maintaining the ceiling tile T in selected position with respect to the members 10. In the embodiment illustrated in FIGS. 1 and 2, clips 18 are of generally inverted U-shaped configuration including spaced leg portions 20, and a connecting bridging portion 22, with the clips being generally resilient so as to provide for resilient clasping or gripping of the T support by the clip, when it is forced down over the vertical rib 12 of the T support 10. Barbs or teeth 24 are provided by partially severed sections of the leg portions, for extending inwardly to grip the confronting enlarged end 16 of the T support, and hold the clip in predetermined position on the T support. As can be seen, the legs are of sufficient length so that the bridging portion 22 does not interfere or ordinarily engage the upper end 16 of the T support when the clip is in full "hold down" position on the support (FIG. 1).

Projecting from adjacent the lower extremity of each leg portion there is provided a foot portion 26 which is adapted to overlie the underlying tile T, and to engage the top surface thereof, thus holding the tile T down against the respective flange portion 14 of the T support. Tab means 28 are provided on each foot portion, which tab means in the embodiment illustrated is formed from a partially severed portion of the foot portion, and projects downwardly from the underside of the respective foot portion. Tab means 28 is adapted to dig into the underlying tile and to anchor it, therefore aiding in maintaining it in selected position with respect to the T support when the tile is cut sufficiently "long", or to engage the side edge E of the adjacent tile (FIG. 5) if the tile happens to be or is cut "short", thus aiding in maintaining the ceiling tile in position irrespective of whether the tile is "long" or "short".

As can be seen, the clip can be readily formed from flat sheet material and can be subsequently bent into the configuration illustrated; or the clip could be formed in the form illustrated per se as by plastic molding or the like. In the form indicated there is no scrap material resulting from the clip formation. In the embodiment illustrated in FIGS. 1 and 2, the tab means 28 is spaced slightly outwardly of the plane of the respective leg portion 20.

Figure 3:
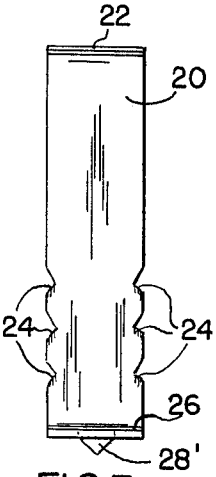
FIG. 3 is a side elevational view of a modified form of tab on the hold down clip.
Figure 4:
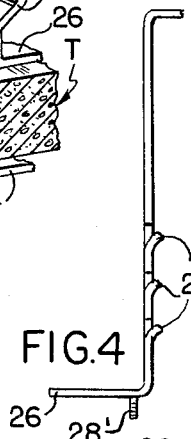
FIG. 4 is a fragmentary, end elevational view of the modified clip of FIG. 3.

Referring now to FIG. 3, there is shown a modification of the clip, and especially the tab means 28' wherein the tab is of sharpened structure, to facilitate its entry into the underlying tile. In this connection, the partially severed section of the foot portion forming the tab may be of generally triangular configuration in plan as opposed to the rectilinear configuration shown in FIG. 2.

Figure 5:
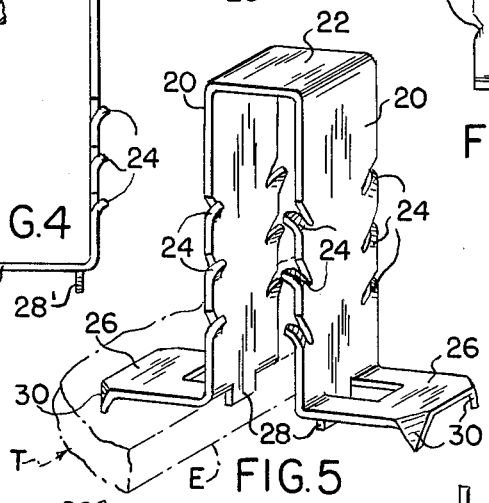
FIG. 5 is an elarged, perspective view of a hold down clip embodying further modified tabs as compared to those of FIGS. 1 and 3.
Figure 6:
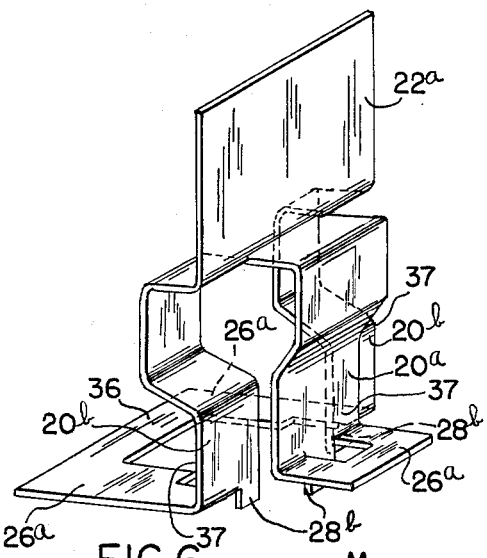
FIG. 6 is a perspective view of a further modified hold down clip formed from a single section of sheet material.
Figure 7:
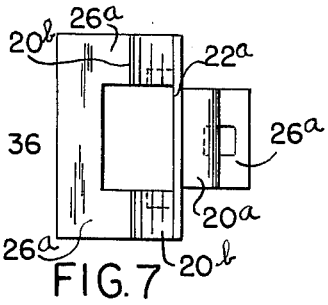
FIG. 7 is a generally reduced size top plan view of the clip of FIG. 6.
Figure 8:
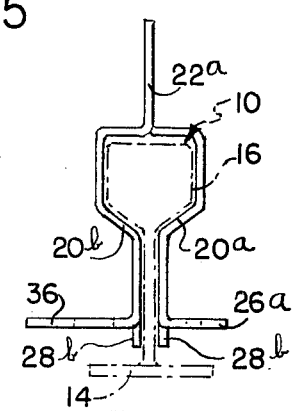
FIG. 8 is an end elevational view of the FIG. 6 clip.
Figure 9:
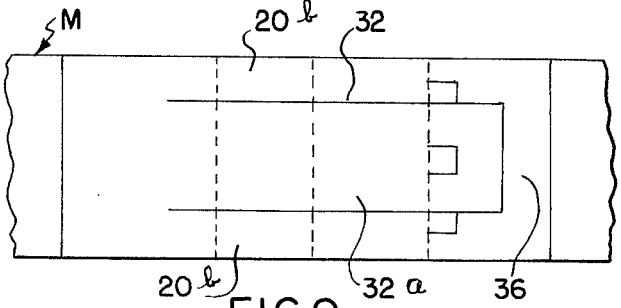
FIG. 9 is a plan view of a section of sheet material showing the partial severing of the sheet section or strip prior to forming the partially severed sheet section into the clip of FIG. 6.

Referring to FIG. 5 there is shown another modification, wherein the outermost corners of the foot portions 26 are bent downwardly into barbs 30 which are adapted to dig into the underlying ceiling tile and maintain the tile in selected position with respect to an associated T support. The other structural characteristics of the FIG. 5 embodiment may be generally similar to that of the FIGS. 1 and 2 embodiment, including the tab means **28*a* formed from the partially severed sections of the foot portions. However, in the embodiment illustrated tabs 28*a* are disposed substantially in the plane of the respective leg portion 20.**

Also as illustrated in FIG. 5, the tab **28*a*** is engageable with the confronting side edge E of the underlying tile rather than digging into the tile in the event that the latter is slightly "short".

Referring now to FIGS. 6 through 9, there is illustrated another embodiment of hold down clip. This embodiment can be produced from flat strip of material M (FIG. 9) of generally of a greater width as compared to the width of the strip of material utilized in producing the prior described embodiments of hold down clip. Strip M may be partially sheared as at 32 (FIG. 9) which delineates a tongue **32*a* adapted to be subsequently bent into leg portion 20*a* of the clip (FIG. 6) and which includes foot portion 26*a* extending laterally from leg portion 20*a*. Leg portions 20*b* are formed so as to be disposed on the opposite side of a plane passing through head section 22*a*. The foot sections 26*a* on leg portions 20*b* are connected by transverse bridging portion 36, while tab portions 28*b* are partially severed sections of foot portions 26*a*. Tab sections 28*b* are adapted to dig into the underlying tile if the latter is "long" or to engage the confronting defining side edge of the tile if the latter is "short". Tabs 28*b* are disposed substantially in the plane of the lower section 37 of the respective leg portion. It will be seen for instance from FIG. 8 that the leg portions 20*a*, 20*b* in this embodiment are so formed that they receive therebetween in encompassing and preferably clasping relation the enlarged upper end portion 16 of the vertical rib of an associated support member of the grid ceiling. If so desired, the leg portions could also be provided with partially severed sections to provide gripping barbs somewhat similar to barbs 24** in the first described embodiments.

Figure 10:
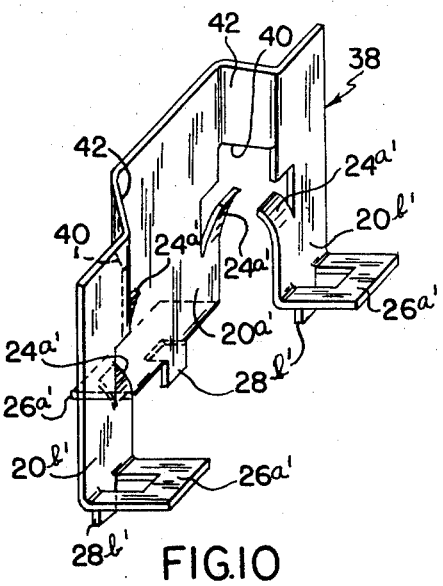
FIG. 10 is a perspective view of a further modified form of hold down clip.
Figure 11:
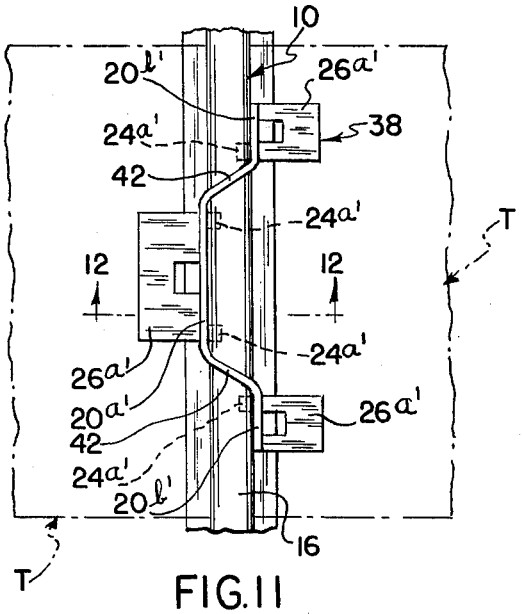
FIG. 11 is a reduced size, top plan view of the clip of FIG. 10 showing its assembly on an inverted T-shaped ceiling grid member.
Figure 12:
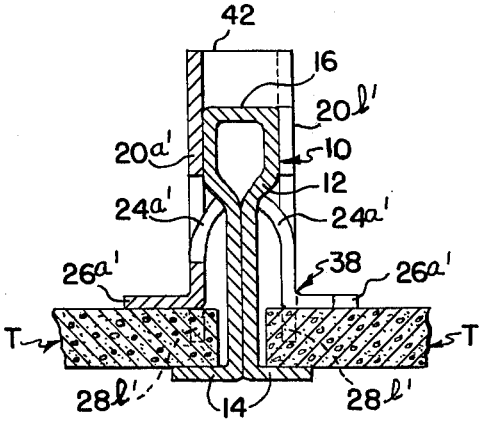
FIG. 12 is an enlarged sectional view taken generally along the plane of line 12—12 of FIG. 11, looking in the direction of the arrows.

Referring now to FIGS. 10 through 12, there is illustrated a further embodiment of hold down clip 38 which is preferably formed from a single piece of sheet material, such as the aforementioned sheet metal, and wherein cutouts or slots 40 are made in the piece of sheet material, so as to define a central leg portion **20*a'* and outside leg portions 20*b'*, with the leg portions 20*a'* and 20*b'* being disposed on opposite sides of a vertical plane through the vertical rib of an associated T support 10, when the hold down clip is in mounted condition on the T support. The foot portions 26*a'* on the respective leg portion project generally horizontally outwardly therefrom, and embody a partially severed section forming a tab means 28*b'* in a generally similar manner as the FIGS. 6 – 8 embodiment. The leg portions may also be partially severed to provide barbs 24*a'* on the leg portions to enable the clip to be positively anchored to the T support, when the clip is in mounted relation thereon. Barbs 24*a'* are so arranged that they coact with the vertical rib just below the enlarged head portion 16 of the T bar support as illustrated in FIG. 12, so as to prevent inadvertent vertical withdrawal movement of the clip when its mounted relation on the associated T bar support. The aforementioned tab means 28*b'* are adapted to either dig into the underlying ceiling tile when the latter is normal or "long", or to engage the defining side edge of the associated ceiling tile when the latter is "short". It will be noted that the connecting bridge portions 42, generally diagonally arranged, provide a torsion force to the leg portions 20*a'*, 20*b'* to urge the latter into clasping engagement with the sides of the upper end portion 16** of the T support.

From the foregoing description and accompanying drawings it will be seen that the invention provides novel hold down clips for ceiling tile in a grid type ceiling, and which include leg portions adapted to be disposed on opposite sides of the T bar support and to generally grip the T bar support, with foot portions projecting laterally from the leg portions and adapted to overlie the tile, and with there being provided tab means on the clip for either digging into the underlying tile or engaging the defining side edge thereof when the latter is "short", thus aiding in maintaining the tile in predetermined position with respect to its associated T support structure.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

What is claimed is:

1. A hold down clip for use with a grid-type ceiling embodying tile supporting members of inverted T cross section, said clip comprising a generally U-shaped clip body having spaced legs for engaging opposite sides of the vertical rib of an associated inverted T member, a foot portion on at least one of said legs adapted to overlie an underlying tile and hold the latter, tab means on said foot portion depending therefrom and substantially normal thereto for coaction with the tile to aid in maintaining the latter in position, and wherein said tab means terminates in a sharpened point means adapted to dig into an underlying tile for maintaining the tile in place.

2. A hold down clip for use with a grid-type ceiling embodying tile supporting members of inverted T cross section, said clip comprising a clip body having spaced legs for engaging opposite sides of the vertical rib of an associated inverted T member, a foot portion on at least one of said legs adapted to overlie an underlying tile and hold the latter, tab means on said foot portion projecting therefrom for coaction with the tile to aid in maintaining the latter in position, and wherein said foot portion has barbs thereon in addition to said tab means, adapted to dig into an underlying tile.

3. A clip in accordance with claim 2 wherein said tab means is so constructed and arranged for engaging a confronting side edge of an underlying tile in the event that the latter is inadvertently short, for maintaining the tile in place.

4. A clip in accordance with claim 2 wherein said legs have serrations thereon adapted for gripping relation with the rib of the associated T member, to lock the clip to the T member.

5. A clip in accordance with claim 2 wherein said foot portion in plan is of generally rectilinear configuration, said barbs being formed by downturned corners of said foot portion.

6. A clip in accordance with claim 2 wherein the clip is initially formed from sheet-like material and said clip body is subsequently bent into inverted generally U-shaped configuration comprising said spaced legs.

7. A clip in accordance with claim 7 wherein said sheet material is sheet metal.

8. A hold down clip for use with a grid-type ceiling embodying tile supporting members of inverted T cross section, said clip comprising a clip body having spaced legs for engaging opposite sides of the vertical rib of an associated inverted T member, a foot portion on at least one of said legs adapted to overlie an underlying tile and hold the latter, tab means on said foot portion projecting therefrom for coaction with the tile to aid in maintaining the latter in position, and wherein said clip is formed from a strip of sheet material and wherein said tab means projects downwardly from said foot portion and is formed from a partially severed section of said foot portion, said legs being substantially planar at least in certain sections thereof with said tab means being substantially disposed in the plane of said certain section of the respective leg.

9. A clip in accordance with claim 8 wherein said clip is formed from a partially severed strip section of generally resilient material and subsequently bent into generally L-shaped spaced interconnected sections comprising said spaced legs with said tab means on each respective leg, certain of said legs being adapted for positioning on one side of the rib of the T member and other of said legs being adapted for positioning on the opposite side of said rib of the T member, said legs being adapted to resiliently grasp the vertical rib of the T member therebetween.

10. A clip in accordance with claim 9 wherein the clip is formed from the sheet metal with the lateral end portions of the clip are formed into said spaced legs adapted to be disposed on one side of said T member, and the central portion of the clip comprising the other of said legs adapted to be disposed on the other side of said T member, with connecting sections generally diagonally arranged connecting said legs on said one side of the T member with said other leg on the other side of the T member, and urging said legs into clasping relation with the T member.

11. A clip in accordance with claim 10 wherein said legs have partially severed edge sections forming inwardly projecting tongues for locking the clip to the T member.

12. A clip in accordance with claim 9 wherein the lateral end portions of the clip form said spaced legs adapted to be disposed on said one side of said T member and the central portion of the clip comprises the other of said legs adapted to be disposed on the other side of the T member, each said leg having a foot portion projecting laterally therefrom, said foot portion on said other leg being formed from a partially severed section of sheet material originally disposed intermediate the foot portions on said end legs and being subsequently formed to extend in a direction opposite to the direction of extensions of said end leg foot portions.

13. A clip in accordance with claim 12 wherein the last mentioned foot portions are joined by a bridging section of material disposed substantially in the plane of said last mentioned foot portions.

* * * * *